United States Patent [19]

Sassano

[11] 4,439,922

[45] Apr. 3, 1984

[54] TAKE-DOWN FOLDING KNIFE

[76] Inventor: Salvatore Sassano, 1011 E. Harrison, Fruita, Colo. 81521

[21] Appl. No.: 404,320

[22] Filed: Aug. 2, 1982

[51] Int. Cl.[3] ..... B26B 3/06

[52] U.S. Cl. ..... 30/161; 30/342

[58] Field of Search ..... 30/155-161, 30/342; 403/85, 92, 93, 146, 149, 325, 327; 81/177 E

[56] References Cited

U.S. PATENT DOCUMENTS

| | | | |
|---|---|---|---|
| 357,353 | 2/1887 | Wiesner | 30/161 |
| 2,407,897 | 9/1946 | Newman | 30/160 |
| 3,942,249 | 3/1976 | Poehlmann | 30/160 |
| 4,133,106 | 1/1979 | Addis | 30/160 |
| 4,170,061 | 10/1979 | Henry | 30/160 |

*Primary Examiner*—E. R. Kazenske
*Assistant Examiner*—Douglas D. Watts
*Attorney, Agent, or Firm*—Norman B. Rainer

[57] ABSTRACT

A folding knife is provided wherein the blade is easily moved from a deployed mode to a stored mode within paired panels that constitute a handle and sheath for the blade. In either mode, the blade is positively and securely locked into position. The entire knife can be easily taken apart for maintenance purposes.

5 Claims, 9 Drawing Figures

TAKE-DOWN FOLDING KNIFE

BACKGROUND OF THE INVENTION

This invention relates to an improved pocket knife wherein the blade is arranged to fold into the handle when not in use in order that the blade may be housed and protected. It is directed primarily toward such a knife which has a minimum number of parts, which can be readily assembled and disassembled with practically no tools, and which operates reliably under all ordinary conditions.

In the folding type of knife, comprised of a blade and associated sheath which houses the blade when it is not in use and serves as a handle when the knife is in use, there is need for the blade to be easily and safely removed from the sheath, and for the blade to be quite secure when deployed for use. It is also important that the mechanism which holds the knife blade between its housed and exposed positions be accurate and dependable in its operation so that there is no inadvertent operation of the structure.

Many varieties of folding knives for both home and sport use have been produced and used over the years. Certain varieties of such knives are dangerous for use under forceful conditions because inadequate latching means enable the blade to snap shut and cut the fingers of the user. In other varieties, large numbers of required parts cause difficulties in maintaining sufficient cleanliness to avoid mechanical malfunction and corrosion, and increase the manufacturing cost.

It is accordingly an object of the present invention to provide a folding knife having positive latching means.

It is a further object of this invention to provide a knife of the aforesaid nature having relatively few parts and capable of facile assembly and disassembly.

It is a still further object of the present invention to provide a folding knife of the aforesaid nature of rugged, durable construction and amenable to low-cost manufacture.

These objects and other objects and advantages of the invention will be apparent from the following description.

SUMMARY OF THE INVENTION

The above and other beneficial objects and advantages are accomplished in accordance with the present invention by an improved folding knife which comprises an elongated blade having a free extremity and an opposed pivoted extremity, a cutting portion adjacent said free extremity, and a substantially flat tang or base portion adjacent said pivoted extremity.

A pivot post is fixedly attached to said tang portion and extends substantially equidistantly from each opposed face of said tang. The pivot post has a generally circular cylindrical outer surface, the longitudinal axis of which is perpendicular to said tang portion. The interior of said pivot post is provided with a cylindrical recess in one extremity, the innermost or bottom of which is a substantially flat surface. A narrow cylindrical channel communicates between the center of the bottom flat surface and a slotted recess in the opposite extremity of the pivot post, said slotted recess being perpendicular to and centered on said axis and communicating with the outer surface of said pivot post.

Two elongated handle panels of substantially indentical outer perimeter configuration, each comprised of a blade-engaging extremity and an opposed free of distal extremity, oppositely disposed receiving and back edges, and inner and outer faces, are interengaged adjacent their back edges in a manner to form an enclosure of uniform spacing between said inner faces. Said handle panels are provided with apertures adjacent their blade-engaging extremities which enable said panels to engage said pivot post. The apertures of said panels have circular contours adapted to make close-fitting contact with the cylindrical outer surface of said pivot post. The aperture of at least one of said handle panels is further characterized in having two diametrically opposed recesses extending outwardly from the generally circular contour of the aperture, said opposed recesses being intended as locking recesses, as will hereinafter be shown.

A locking key is disposed within the pivot post, said key having a generally T-shaped configuration comprising a leg portion which perpendicularly bisects a head portion having pendant shoulders extending in the direction of the leg portion. The leg portion is of cylindrical cross section, and its free end is externally threaded. The locking key is adapted to fit within the pivot post in a manner such that the head portion is held within the aforementioned slotted recess, and the leg portion extends through the aforesaid cylindrical channel. The threaded extremity of the leg engages a retainer adapted to fit within the circular recess of said pivot post. A coil spring is disposed about the leg portion of said locking key in spanning abutment with both said retainer and the bottom flat surface. By virtue of its particular mode of engagement with the pivot post, the locking key can be moved transversely with respect to the blade. The extent of transverse mobility is such as to enable the pendant shoulders to be drawn into said locking recesses in one of the handle panels by virtue of the action of the spring, and to be removable from said locking recesses by manual displacement of the key against the force of the spring.

The effect of the aforesaid arrangement of components is to enable the blade to be rotated 180° to either its sheathed or deployed mode and lock in either mode by engagement of the head portion of the locking key with both the slotted recess of the pivot post and the locking recesses of one of the handle panels.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
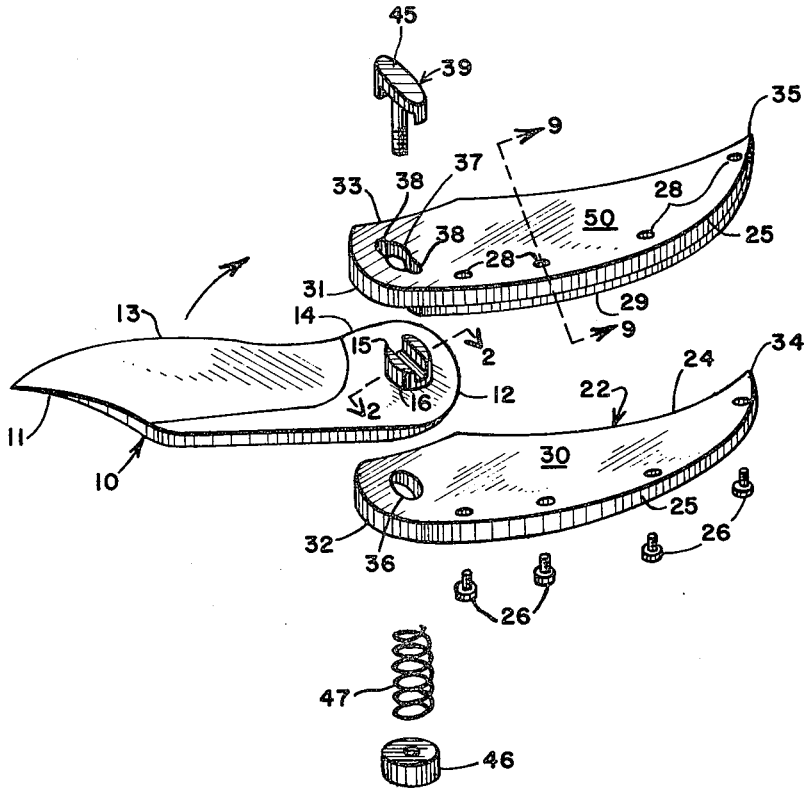
FIG. 1 is an exploded perspective view of an embodiment of the knife of this invention.

Referring to FIG. 1, an embodiment of the folding knife of the present invention is comprised of elongated blade 10 shown in its deployed mode having a free extremity 11 and opposed pivoted extremity 12. A cutting edge 13 is provided along one side of the blade extending to said free extremity. A substantially flat tang or base portion 14 is positioned adjacent said pivoted extremity.

Figure 2:
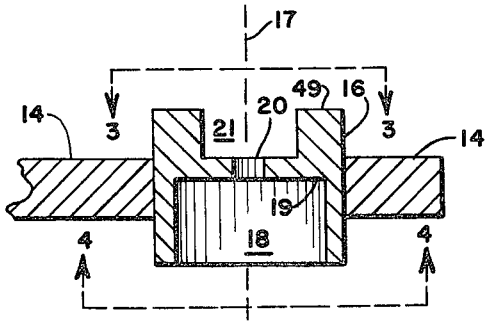
FIG. 2 is an enlarged sectional view of the pivot post taken along the line 2—2 of FIG. 1.
Figure 3:
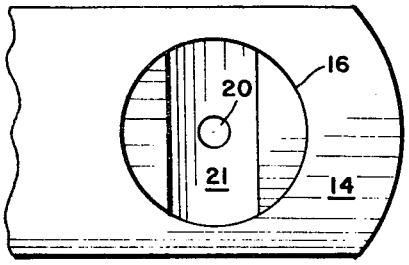
FIG. 3 is a top plan view of the pivot post taken along the line 3—3 of FIG. 2.
Figure 4:
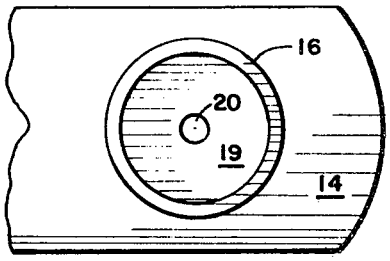
FIG. 4 is a bottom plan view of the pivot post taken along the line 4—4 of FIG. 2.
Figure 5:
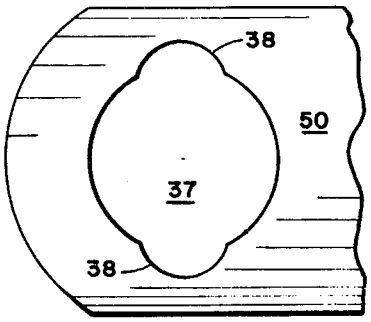
FIG. 5 is an enlarged fragmentary view of the blade-engaging extremity of the first handle panel.
Figure 6:
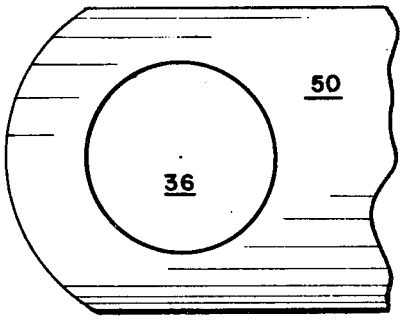
FIG. 6 is an enlarged fragmentary view of the blade-engaging extremity of the second handle panel.

A pivot post 15 is fixedly attached to said tang and extends substantially equidistantly from each opposed face of said tang, as shown more clearly in FIG. 2. The pivot post has a generally circular cylindrical outer surface 16, having a longitudinal axis 17 which is perpendicularly disposed to said tang. The interior of said pivot post is provided with a cylindrical recess 18, the innermost or bottom extremity of which is a substantially flat abutment surface 19. A narrow cylindrical channel 20 communicates between the center of abutment surface 19 and a slotted recess 21 positioned in that extremity of the pivot post which is opposite to the extremity having cylindrical recess 18. Slotted recess 21 is perpendicular to and centered on axis 17, and communicates with cylindrical outer surface 16. The upper surface 49 of pivot post 15 is disposed at a height above base portion 14 such as to reside in coplanar engagement with outer surface 50 of panel 23, as will hereinafter be shown.

Elongated handle panels 22 and 23 of substantially identical outer perimeter configuration comprised of receiving edges 24 and opposed back edges 25, are interengaged adjacent their back edges by threaded bolts 26 adapted to penetrate holes 27 in panel 22 and aligned threaded holes 28 in panel 23. Spacing means such as strip 29 associated with panel 23 causes the interengaged panels to form an enclosure of uniform spacing between inner faces 30 and 31. The handle panels may be further characterized in having outer surfaces 50 and 51, blade-engaging extremities 32 and 33, and distal or free extremities 34 and 35. Apertures 36 and 37, positioned in blade-engaging extremities 32 and 33 respectively, are adapted to make close-fitting, rotatably sliding engagement with the portions of cylindrical surface 16 that extend above each face of tang 14. Both apertures 36 and 37 are preferably comprised at least in part of circular periphery. However, at least one of said apertures, such as aperture 37, is further provided with two diametrically opposed locking recesses 38 extending outwardly from the generally circular contour of the aperture.

Figure 7:
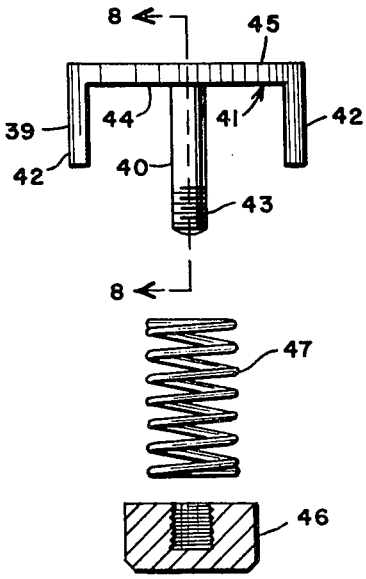
FIG. 7 is an exploded sectional view of the blade-locking mechanism.
Figure 8:
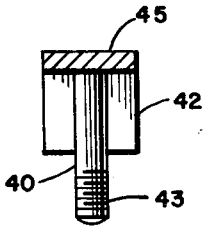
FIG. 8 is a sectional side view taken along the line 8—8 of FIG. 7.
Figure 9:
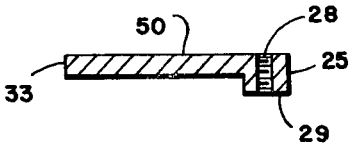
FIG. 9 is a sectional side view taken along the line 9—9 of FIG. 1.

A locking key 39, illustrated in FIGS. 1, 7 and 8, is disposed within pivot post 15. Said key 39 has a generally T-shaped configuration comprising a leg portion 40 perpendicularly attached to the center of head portion 41 having pendant shoulders 42 which extend in the direction of leg portion 40. Said leg portion is preferably of circular cylindrical cross section, having a diameter small enough to enable passage through channel 20, and having an externally threaded free end 43. Locking key 39 is adapted to fit within pivot post 15 in a manner such that head portion 41 is snugly held within slotted recess 21 while leg portion 40 resides in closefitting sliding contact within channel 20. The length of head portion 41 measured along its underside 44, and the maximum width measured across the upper face 45 of the head portion must accordingly be commensurate with the dimensions of slotted recess 21. The thickness of head portion 41, measured between upper face 45 and underside 44, is such as to enable the head portion to engage slotted recess 21 while upper face 45 resides in substantially coplanar engagement with the outer face of panel 23.

Free end 43 of said locking key threadably engages retainer 46 of circular contour adapted to fit at least in part within cylindrical recess 18. A coil spring 47 is disposed about leg 40 in spanning abutment with abutment surface 19 and retainer 46. Pendant shoulders 42 are dimensioned and positioned in a manner such that, when the locking key is properly positioned, said shoulders will be accommodated by locking recesses 38.

The knife is assembled in a manner such that aperture 37 of handle panel 23 is caused to engage the portion of the pivot post having slotted recess 21, the locking recesses 38 associated with aperture 37 being aligned with the extremities of slotted recess 21. Handle panel 22 is then brought into engagement with the opposite extremity of pivot post 15 in a manner such that receiving edges 24 and back edges 25 of the handle panels are in alignment, and spacing means 29 is interposed between inner faces 30 and 31. The panels are then interengaged by bolts 26. The locking key is entered into pivot post 15 through slotted recess 21 so that leg portion 40 penetrates channel 20, and shoulders 42 reside within locking recesses 38. The coil spring is placed in position on leg portion 40, and the free end 43 of said leg portion is then engaged by retainer 46.

The locking key is dimensioned such that pendant shoulders 42 remain in engagement with locking recesses 38 in both the open and closed modes of the knife and in transitional movements between said modes. The upper face 45 of head portion 41 of said locking key is disposed to reside in flush-fitting engagement with the outer surface of panel 23. When it is desired to change the position of the blade, retainer 46 is pressed inwardly toward the slotted recess. This action causes head portion 41 to disengage from the slotted recess, permitting rotation of the blade about pivot post 15. Upon releasing pressure on the retainer, the head portion is drawn back into the slotted recess by action of spring 47.

The effect of the aforesaid arrangement of components is to enable the blade to be rotated 180° in the direction shown by the arrow in FIG. 1 to either its sheathed or deployed mode, and lock in either mode by engagement of the head portion of locking key 39 with both slotted recess 21 of pivot post 15 and locking recesses 38 of one of the handle panels.

The entire knife can easily be dismantled to its separate component parts for cleaning purposes merely by loosening retainer 46 and bolts 26.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A take-down folding knife comprising:

(a) a blade having a free extremity and an opposed pivoted extremity, a cutting portion adjacent said free extremity and a tang portion defined by two flat, uniformly spaced faces adjacent said pivoted extremity, (b) a pivot post fixedly attached to said tang portion and extending substantially equidistantly from each face thereof, said pivot post having a generally circular cylindrical outer surface the longitudinal axis of which is perpendicular to said tang portion, and an interior having a cylindrical recess in one extremity, a slotted recess in the opposite extremity, and a cylindrical channel communicating between said recesses, (c) two elongated handle panels of substantially indentical outer perimeter configuration, each comprised of a blade-engaging extremity and an opposed free extremity, oppositely disposed receiving and back edges, and inner and outer faces, said blade engaging extremities being provided with apertures by which said panels pivotably engage said pivot post, said panels being interconnected by threaded fasteners adjacent said back edges to form an enclosure of uniform spacing between said inner faces, (d) the aperture of at least one of said handle panels having two diametrically opposed locking recesses, said handle panel engaging the extremity of said pivot post having said slotted recess, (e) a locking key disposed within said pivot post, said locking key having a generally T-shaped configuration comprising a leg portion, and a head portion having pendant shoulders extending in the direction of said leg portion, being adapted to slideably fit within said cylindrical channel and having a threaded extremity, said head portion being adapted to fit at least partially within said slotted recess while said shoulders enter said locking recesses, (f) retainer means adapted to engage the threaded extremity of said leg portion and fit at least partially within said cylindrical recess, and (g) a coil spring disposed about said leg portion and in abutment with said retainer means and said pivot post in a manner to draw said locking key into said pivot post, whereby (h) the head portion of said locking key, when drawn into said pivot post by said spring, locks the position of the blade by engagement with said slotted recess and the locking recesses of one of said handle panels when the blade is either in its deployed mode or in its sheathed mode between said handle panels, and (i) rotation of said blade to either of its two locked modes is permitted by forcing said locking key from said pivot post against the action of said spring.

2. The knife of claim 1 wherein said cylindrical channel is perpendicularly disposed to said blade.

3. The knife of claim 1 wherein said locking recesses extend outwardly from the aperture of said handle panel as continuous extensions of said aperture.

4. The knife of claim 1 wherein said retainer means is of circular contour having a depressed threaded channel centered therein.

5. The knife of claim 1 wherein all component parts are fabricated of corrosion resistant material.

* * * * *